US010304379B2

(12) United States Patent
Matsui et al.

(10) Patent No.: US 10,304,379 B2
(45) Date of Patent: May 28, 2019

(54) DISPLAY DEVICE AND METHOD FOR DRIVING DISPLAY DEVICE

(71) Applicant: JOLED INC., Tokyo (JP)

(72) Inventors: Masafumi Matsui, Tokyo (JP); Eiji Iwauchi, Tokyo (JP); Tomoyuki Maeda, Tokyo (JP)

(73) Assignee: JOLED, INC., Tokyo (JP)

( * ) Notice: Subject to any disclaimer, the term of this patent is extended or adjusted under 35 U.S.C. 154(b) by 0 days.

(21) Appl. No.: 15/310,979

(22) PCT Filed: May 12, 2015

(86) PCT No.: PCT/JP2015/002405
§ 371 (c)(1),
(2) Date: Nov. 14, 2016

(87) PCT Pub. No.: WO2015/174077
PCT Pub. Date: Nov. 19, 2015

(65) Prior Publication Data

US 2017/0076668 A1 Mar. 16, 2017

(30) Foreign Application Priority Data

May 15, 2014 (JP) ..... 2014-101764

(51) Int. Cl.
*G09G 3/3233* (2016.01)

(52) U.S. Cl.
CPC ..... *G09G 3/3233* (2013.01); *G09G 2310/08* (2013.01); *G09G 2320/0233* (2013.01); *G09G 2320/043* (2013.01); *G09G 2360/16* (2013.01)

(58) Field of Classification Search
CPC ..... G09G 3/3233; G09G 2310/08; G09G 2320/0233; G09G 2320/043; G09G 2300/16
(Continued)

(56) References Cited

U.S. PATENT DOCUMENTS 7,227,519 B1 * 6/2007 Kawase ..... G09G 3/2081 345/77
8,508,441 B2 * 8/2013 Kimura ..... G09G 3/3233 345/77
(Continued)

FOREIGN PATENT DOCUMENTS

JP 2000-132139 5/2000
JP 2000-356981 12/2000
(Continued)

OTHER PUBLICATIONS

International Search Report (ISR) from International Searching Authority (Japan Patent Office) in International Pat. Appl. No. PCT/JP2015/002405, dated Aug. 4, 2015.

*Primary Examiner* — Mark W Regn
(74) *Attorney, Agent, or Firm* — Greenblum & Bernstein, P.L.C.

(57) ABSTRACT

A display device includes: a display unit which includes a plurality of pixels each including an organic EL element; and a control unit which adjust a value of a luminance signal to be supplied to a target pixel to be corrected, such that an actual luminance of the target pixel is equal to a reference luminance, the reference luminance being an actual luminance of a reference pixel obtained when the luminance signal to be supplied to the target pixel is supplied to the reference pixel. The reference pixel has predetermined attenuation characteristics for light emission amount.

13 Claims, 6 Drawing Sheets

(58) Field of Classification Search
USPC ..... 345/691
See application file for complete search history.

(56) References Cited

U.S. PATENT DOCUMENTS

| | | | | |
|---|---|---|---|---|
| 2009/0174628 | A1* | 7/2009 | Wang | G09G 3/3225 345/76 |
| 2010/0265228 | A1* | 10/2010 | Kimura | G09G 3/3233 345/207 |
| 2013/0257845 | A1* | 10/2013 | Chaji | G09G 3/3291 345/212 |
| 2016/0232842 | A1 | 8/2016 | Imai | |

FOREIGN PATENT DOCUMENTS

| | | |
|---|---|---|
| JP | 2001-175221 | 6/2001 |
| JP | 2001-350442 | 12/2001 |
| JP | 2006-195310 | 7/2006 |

* cited by examiner

DISPLAY DEVICE AND METHOD FOR DRIVING DISPLAY DEVICE

TECHNICAL FIELD

The present invention relates to a display device, and particularly to a display device including organic electroluminescent (EL) elements and a method for driving the display device.

BACKGROUND ART

An organic electroluminescent (hereinafter, referred to as "organic EL") display including organic EL elements is known as an image display device including current-driven light emitting elements. The organic EL display has advantages in good viewing angle characteristics and low power consumption.

An organic EL display generally includes: pixels arranged in a matrix; and scanning lines and data lines connected to the pixels. Each pixel includes, for example, an organic EL element, a drive transistor for driving the organic EL element, and a selection transistor for switching between selection and non-selection of the pixel. For example, in an active matrix organic EL display, the selection transistors of the pixels are provided at the respective intersections of the scanning lines and the data lines. Each selection transistor is connected to a storage capacitor element (a capacitor) and the gate of the drive transistor.

CITATION LIST

Patent Literature

[PTL 1] Japanese Unexamined Patent Application Publication No. 2006-195310

SUMMARY OF INVENTION

Technical Problem

However, it is known that the organic EL element deteriorates over time due to a current which flows through the organic EL element when an image is displayed. A deteriorated organic EL element provides an actual luminance less than that provided before the deterioration, in response to the same amount of current supplied.

The deterioration amount of an organic EL element varies according to the cumulative amount of current. When an image is to be displayed on an organic EL display, a luminance signal (luminance data) obtained from an image signal varies over time, and differs for each organic EL element. This results in variations in deterioration amount among the organic EL elements included in one organic EL display. Moreover, the variations in deterioration amount of the organic EL elements may deteriorate the image quality.

In view of the above, the present invention provides a display device with a simpler configuration capable of reducing deterioration of the image quality resulting from deterioration of light emitting elements, and a method for driving the display device.

Solution to Problem

A display device according to one aspect of the present invention is includes: a display unit which includes a plurality of pixels each including a light emitting element; and a control unit which adjusts a value of a luminance signal to be supplied to a target pixel to be corrected, such that an actual luminance of the target pixel is equal to a reference luminance, the reference luminance being an actual luminance of a reference pixel obtained when the luminance signal to be supplied to the target pixel is supplied to the reference pixel, the reference pixel having a predetermined attenuation characteristic for light emission amount.

Advantageous Effects of Invention

A display device and a method for driving the display device according to one aspect of the present invention each are capable of reducing deterioration of the image quality resulting from deterioration of light emitting elements.

DESCRIPTION OF EMBODIMENT (Details of Problems)

Figure 1A:
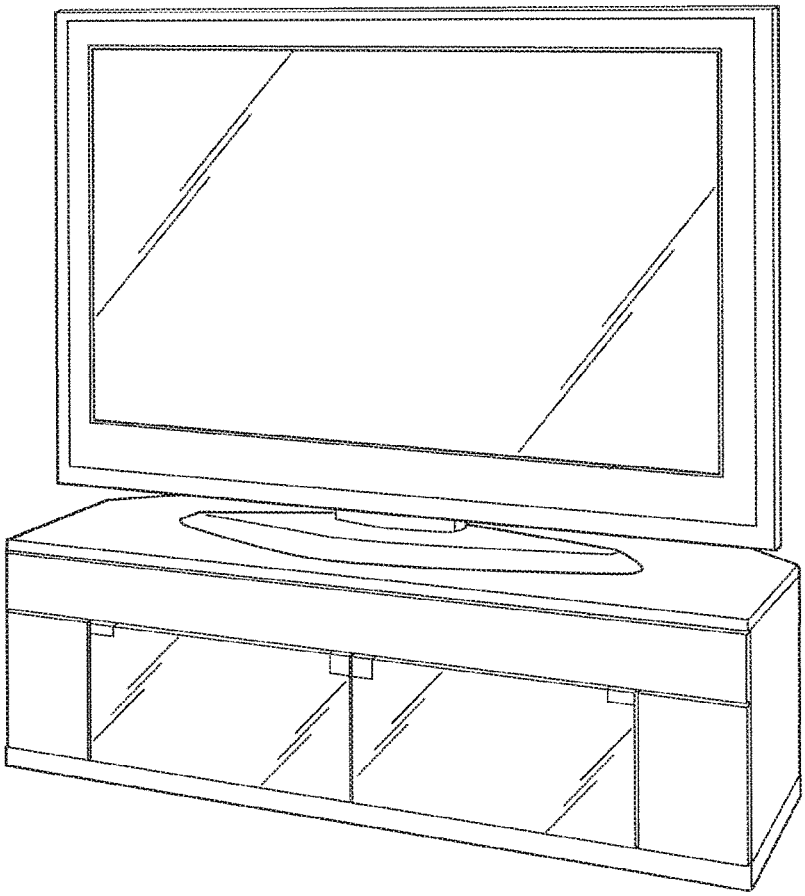
FIG. 1A is an external view of an organic EL display.

As described above, the actual luminance of an organic EL element decreases over time, that is deteriorates over time. The deterioration amount here refers to, for example, an integral value. Specifically, the deterioration amount is obtained, for example, from accumulation of multiplication values (hereinafter, referred to as load) for all frames displayed so far. The multiplication values each are obtained by multiplying the light emission period by the current value. In other words, since the deterioration amount of an organic EL element varies according to the load as well as the amount of current, the deterioration amount can be determined by calculating the load from the history of the image signals. The amount of current is obtained from the luminance signal (luminance data) of an image signal.

The deterioration amount is represented by, for example, the rate of the actual luminance at the time of calculation of the deterioration amount relative to the initial actual luminance before the deterioration. In deriving the deterioration amount, the amount of current is used as one of the parameters.

It can be generally said that a pixel with a larger amount of current has larger load, leading to a larger deterioration amount. Examples of a pixel with a larger amount of current include a pixel positioned in a region where an image with large luminance data is displayed over a long period of time (hereinafter, appropriately referred to as "high luminance region"), such as a region where a logo of a broadcast program is displayed or a region where time is displayed. The deterioration amount of a pixel positioned in the high luminance region is larger than a pixel positioned in the surrounding region where an image with relatively small luminance data is displayed (hereinafter, appropriately referred to as "low luminance region") (burn-in phenomenon).

In other words, generally, the luminance data to be supplied to each of the pixels included in one organic EL display is not uniform. This varies the deterioration amount of the pixels according to the luminance data of an image signal. As described above, in the case where the same luminance data is supplied to pixels and if the variations in deterioration amount are present, the actual luminance of the pixels varies according to the deterioration amount. As a result, the image quality is reduced.

In view of the above, for example, a technique has been disclosed which adjusts the luminance data to be supplied to the organic EL elements so as to approximately equalize the deterioration amount (for example, see Patent Literature 1).

However, in order to approximately equalize the deterioration levels of all the pixels, for example, it is necessary to reduce the amount of current flowing through a pixel with a high level of deterioration by reducing the value of the luminance data for a predetermined period so as to slow the progress of deterioration.

In this case, for example, the value of the luminance data is reduced in the high luminance region for a predetermined period, and thus, the actual luminance is reduced. By doing so, the actual luminance of the high luminance region is reduced and the actual luminance of the surrounding low luminance region is maintained. This may give a user a feeling of dissonance. In other words, the difference among the actual luminance levels in the image that is actually displayed on the organic EL display becomes smaller than the difference among the luminance levels in the image signal included in the broadcast wave (the difference among luminance data). This may reduce the image quality.

In view of the above, the following embodiment provides, for example, a method for, while avoiding excessive reduction in life of the display, maintaining a luminance difference relationship in luminance data of a video signal and in the actual luminance (equalizing the actual luminance difference and the luminance data difference), and improving the burn-in phenomenon.

In order to solve the above problems, a display device according to one aspect of the present invention includes: a display unit which includes a plurality of pixels each including a light emitting element; and a control unit which adjusts a value of a luminance signal to be supplied to a target pixel to be corrected, such that an actual luminance of the target pixel is equal to a reference luminance, the reference luminance being an actual luminance of a reference pixel obtained when the luminance signal to be supplied to the target pixel is supplied to the reference pixel, the reference pixel having a predetermined attenuation characteristic for light emission amount.

The display device having such a configuration performs control so as to equalize the attenuation characteristics for light emission amount generated overt time among the pixels rather than equalizing the deterioration amount among the pixels. In other words, in the display device having the above configuration, the value of the luminance signal to be supplied to a target pixel to be corrected is adjusted such that the actual luminance of the target pixel is equal to the actual luminance of a reference pixel having predetermined attenuation characteristics for light emission amount. Accordingly, it is possible to maintain the luminance difference between the high luminance region and the low luminance region of an image signal. Since the display device having the above configuration is capable of maintaining an intended luminance difference in an image signal, reduction in image quality can be more effectively prevented.

The reference pixel may be a virtual pixel and need not be actually formed within the display device.

The actual luminance refers to the amount of light emission generated when a pixel actually emits light.

For example, it may be that the predetermined attenuation characteristic for light emission amount is defined by an attenuation amount of the actual luminance of the reference pixel relative to elapsed time, the predetermined attenuation characteristic for light emission amount is set such that the attenuation amount is (i) greater than a minimum deterioration characteristic in which the attenuation amount relative to elapsed time is minimum, and (ii) less than a maximum deterioration characteristic in which the attenuation amount relative to elapsed time is maximum, and the minimum deterioration characteristic and the maximum deterioration characteristic are statistically estimated.

The minimum deterioration characteristics and the maximum deterioration characteristics refer to the physical deterioration characteristics obtained statistically. The minimum deterioration characteristics and the maximum deterioration characteristics may be represented by given units such as the rate of the current actual luminance relative to the initial actual luminance, or the (level of) difference between the initial actual luminance and the current actual luminance.

If the attenuation characteristics for light emission amount are set to minimum deterioration characteristics, a large amount of current constantly flows through a light emitting element. Accordingly, the progress of actual deterioration of the pixel is accelerated, leading to a shorter product life.

On the other hand, if the attenuation characteristics for light emission amount are set to maximum deterioration characteristics, the progress of the actual deterioration of the pixel can be slowed. However, this increases the attenuation amount of the actual luminance generated over time.

In view of the above, in the display device having the above configuration, the attenuation characteristics for light emission amount are set to be greater than the minimum deterioration characteristics, and to be less than the maximum deterioration characteristics. Accordingly, the progress of the physical deterioration of pixel can be slowed compared to the case where the attenuation characteristics for light emission amount are set to the minimum deterioration characteristics. Additionally, the attenuation amount of the actual luminance generated over time can be reduced compared to the case where the attenuation characteristics for light emission amount are set to the maximum deterioration characteristics.

For example, it may be that the predetermined attenuation characteristic for light emission amount is predesigned according to a specification of the display device.

According to the display device having the above configuration, the attenuation characteristics for light emission amount can be designed according to the specification of the display device. Hence, it is possible to control the attenuation amount of the actual luminance of the display device.

For example, it may be that, in the adjustment of the value of the luminance signal, the control unit is configured to: reduce the value of the luminance signal for a first pixel having a first deterioration characteristic in which an attenuation amount relative to elapsed time is less than the predetermined attenuation characteristic for light emission amount; and increase the value of the luminance signal for a second display signal having a second deterioration characteristic in which an attenuation amount relative to elapsed time is greater than the predetermined attenuation characteristic for light emission amount.

According to the display device having the above configuration, the value of the luminance signal for a first pixel having first deterioration characteristics with a small attenuation amount is reduced, and the value of the luminance signal for a first pixel having first deterioration characteristics with a large attenuation amount is increased. Accordingly, it is possible to obtain two advantageous effects: slowing the progress of deterioration of pixels and reducing an increase in attenuation amount of the actual luminance.

For example, it may be that the light emitting element is an organic electroluminescent element.

Variations in deterioration of the pixels in an organic EL display are greater than those in a liquid crystal display or the like. Hence, application of the display device having the above configuration allows the image quality to be improved or to be appropriately maintained.

Moreover, the method for driving the display device according to one aspect of the present invention is a method for driving a display device which includes a display unit which includes a plurality of pixels each including a light emitting element. The method includes: adjusting a value of a luminance signal to be supplied to a target pixel to be corrected, such that an actual luminance of the target pixel is equal to a reference luminance, the reference luminance being an actual luminance of a reference pixel obtained when the luminance signal to be supplied to the target pixel is supplied to the reference pixel, the reference pixel having a predetermined attenuation characteristic for light emission amount.

In the method for driving the display device having the above configuration, the value of the luminance signal to be supplied to a target pixel to be corrected is adjusted such that the actual luminance of the target pixel is equal to the actual luminance of a reference pixel having predetermined attenuation characteristics for light emission amount. Accordingly, it is possible to maintain the luminance difference between the high luminance region and the low luminance region of an image signal.

Note that these general and specific aspects may be implemented using a system, a method, an integrated circuit, a computer program, or a computer-readable recording medium such as a CD-ROM, or any combination of systems, methods, integrated circuits, computer programs, or computer-readable recording media.

Hereinafter, an embodiment will be specifically described with reference to the drawings.

The embodiment described below shows a general or specific example. The numerical values, shapes, materials, structural components, the arrangement and connection of the structural components, steps, the processing order of the steps etc. shown in the following embodiment are mere examples, and therefore are not intended to limit the present invention. Among the structural components in the following embodiment, structural components not recited in any one of the independent claims which indicate the broadest concepts are described as arbitrary structural components.

Embodiment

A display device and a method for driving the display device according to an embodiment will be described with reference to FIG. 1A to FIG. 5. In the present embodiment, an example where the display device is an organic EL display will be described.

The actual luminance of a display device such as an organic EL display is generally known to deteriorate over time. The display device according to the present embodiment does not completely eliminate the deterioration of the actual luminance generated over time, but controls the deterioration of the actual luminance generated over time to predesigned characteristics. This makes it possible to reduce variations in deterioration of the actual luminance among products.

The following describes the definitions of the terms used in the present embodiment.

In the present embodiment, the term "physical deterioration amount" refers to the amount of reduction, over time, of the actual luminance (light emission amount) generated when luminance data obtained from an image signal, that is, uncorrected luminance data is supplied to a pixel. The physical deterioration amount differs among individual pixels.

In the present embodiment, the term "attenuation characteristics for light emission amount" refers to the attenuation amount of the actual luminance over time defined by the design. The physical deterioration amount cannot be controlled by the design (the physical deterioration amount differs depending on the image to be displayed), whereas the attenuation characteristics for light emission amount can be controlled by the design. The attenuation characteristics for light emission amount are uniform among all the pixels.

1. Configuration of Display Device

Figure 1B:
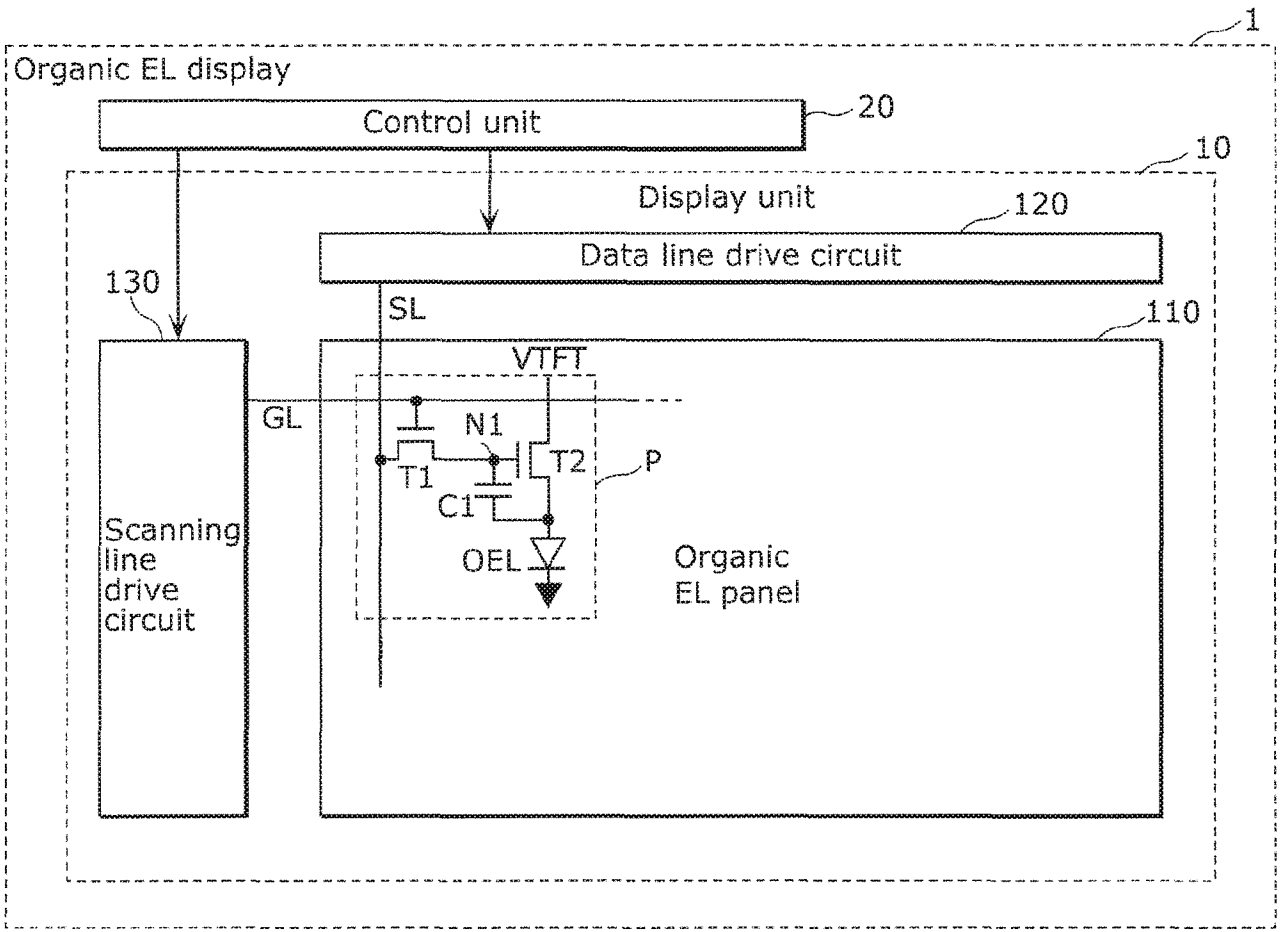
FIG. 1B is a block diagram illustrating an example of a configuration of an organic EL display according to an embodiment.

FIG. 1A is an external view of an organic EL display 1, and FIG. 1B is a block diagram illustrating an example of a configuration of the organic EL display 1.

As FIG. 1B illustrates, the organic EL display 1 includes a display unit 10 and a control unit 20.

The display unit 10 includes an organic EL panel 110, a data line drive circuit 120, and a scanning line drive circuit 130.

The organic EL panel 110 includes a plurality of pixels P arranged in a matrix, and a plurality of scanning lines GL and a plurality of data lines SL which are connected to the pixels P.

In the present embodiment, each pixel P includes an organic EL element OEL, a selection transistor T1, a drive transistor T2, and a capacitor element C1.

The selection transistor T1 switches between selection and non-selection of the pixel P according to a driving signal outputted from the control unit 20. The selection transistor T1 is a thin film transistor (TFT), and has a gate terminal connected to the scanning line GL, a source terminal connected to the data line SL, and a drain terminal connected to a node N1.

The drive transistor T2 supplies driving current corresponding to the voltage value of the data line SL to the organic EL element OEL. The drive transistor T2 is a thin film transistor. The drive transistor T2 has a gate terminal connected to the node N1, a source terminal connected to an anode electrode of the organic EL element OEL, and a drain terminal to which voltage VTFT is supplied.

The organic EL element OEL is a light emitting element which emits light according to the driving current. The driving current is supplied from the drive transistor T2. The organic EL element OEL has an anode electrode connected to the source terminal of the drive transistor T2, and a cathode electrode which is grounded.

The capacitor element C1 has a first terminal connected to the node N1, and a second terminal connected to the source terminal of the drive transistor T2.

The data line drive circuit 120 supplies, to the data lines SL, voltage corresponding to a correction signal outputted from the control unit 20.

The scanning line drive circuit 130 supplies, to the scanning lines GL, voltage corresponding to the driving signal outputted from the control unit 20.

In the present embodiment, an example has been described where the selection transistor T1 and the drive transistor T2 each are an N-type TFT. However, the selection transistor T1 and the drive transistor T2 each may be a P-type TFT. In this case, too, the capacitor element C1 is connected between the gate and the source of the drive transistor T2.

The control unit 20 is a circuit for controlling display of an image on the organic EL panel 110, and includes, for example, a timing controller (TCOM). The control unit 20, for example, sequentially obtains, from an image signal, a luminance signal to be supplied to each of the pixels P included in the organic EL panel 110. The control unit 20 further corrects each luminance signal. The correction of the luminance signal is performed, for example, according to the physical deterioration amount of the organic EL element OEL in the pixel P corresponding to the target luminance signal to be corrected, and the attenuation characteristics for light emission amount. Hereinafter, the luminance signal after the correction is referred to as a correction signal. The control unit 20 outputs a correction signal to the data line drive circuit 120. In the following description, the pixel P corresponding to the luminance signal currently being corrected in the control unit 20 is referred to as a target pixel P to be corrected.

Figure 2:
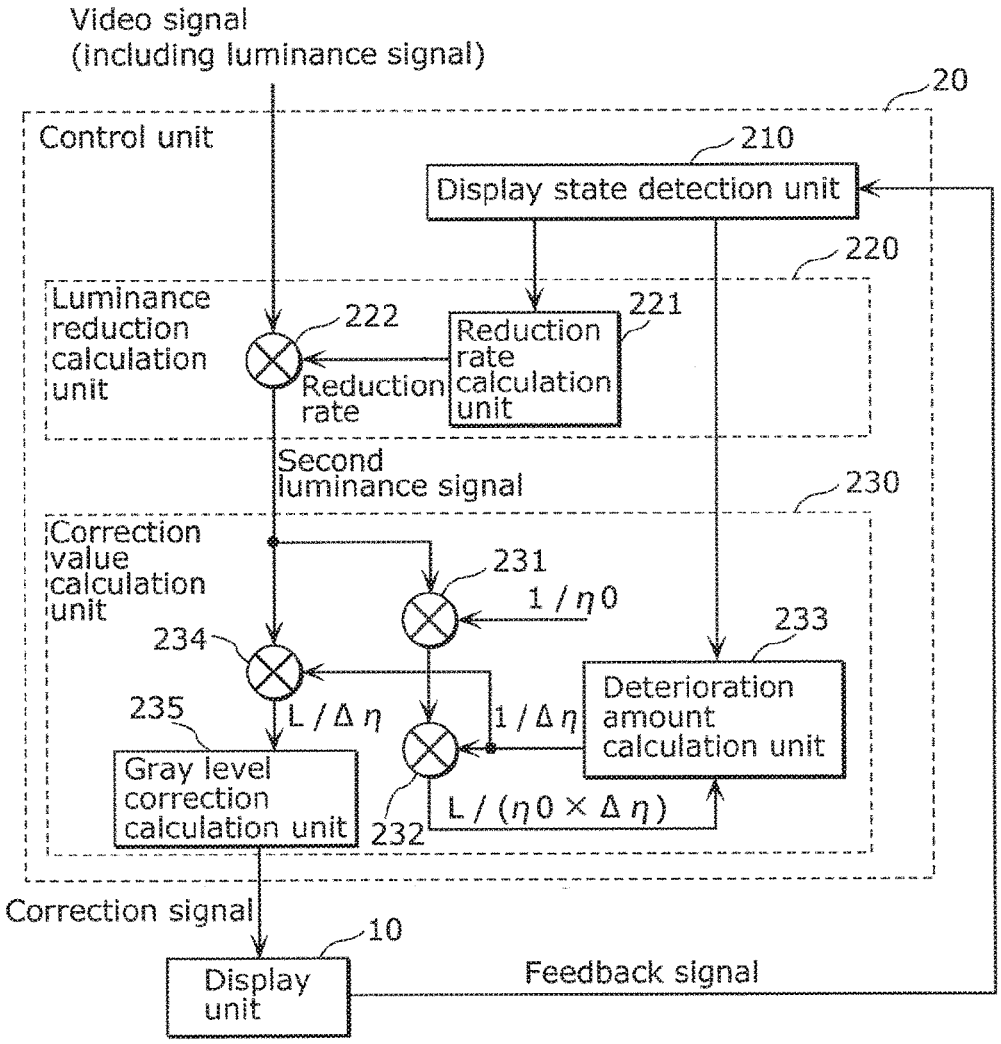
FIG. 2 is a block diagram illustrating an example of a configuration of a control unit according to an embodiment.

FIG. 2 is a block diagram illustrating an example of a configuration of the control unit 20. As FIG. 2 illustrates, the control unit 20 includes a display state detection unit 210, a luminance reduction calculation unit 220, and a correction value calculation unit 230.

The display state detection unit 210 detects the display state based on a feedback signal provided from the display unit 10. Here, the display state refers to, for example, the light emission state of the organic EL panel 110.

The luminance reduction calculation unit 220 equally reduces the values of the luminance signals for all of the pixels P in the organic EL panel 110 at the same reduction rate. The luminance reduction calculation unit 220 includes a reduction rate calculation unit 221 and a multiplier 222.

More specifically, the luminance reduction calculation unit 220 obtains a luminance signal from the image signal for displaying an image on the display unit 10. The reduction rate calculation unit 221 obtains, based on information provided from the display state detection unit 210, a lighting period which is an accumulation of periods during which images are displayed on the organic EL panel 110. Subsequently, the reduction rate calculation unit 221 derives the reduction rate according to the lighting period. The reduction rate is set in advance according to the panel lighting period. The multiplier 222 generates a second luminance signal by multiplying the luminance signal obtained from the image signal by the reduction rate calculated by the reduction rate calculation unit 221.

The correction value calculation unit 230 calculates, for each pixel P, a correction signal obtained by correcting the second luminance signal according to the deterioration amount. The correction value calculation unit 230 includes multipliers 231,232 and 234, a deterioration amount calculation unit 233, and a gray level correction calculation unit 235. The operations of the respective structural components in the correction value calculation unit 230 will be described later.

2. Driving Method

The method for driving the display device according to the present embodiment (the operations of the correction value calculation unit 230) will be described with reference to FIGS. 3 to 5.

[2-1. Attenuation Characteristics for Light Emission Amount]

First, prior to the description of the operations of the correction value calculation unit 230, the attenuation characteristics for light emission amount used in the reduction rate calculation unit 220 will be described.

In the present embodiment, the attenuation characteristics for light emission amount are, as described above, represented by the reduction amount of the actual luminance relative to time. The attenuation characteristics for light emission amount are characteristics determined by the design.

The attenuation characteristics for light emission amount may be set according to, for example, the specification of the organic EL display 1, the specification of product life, or the half life of the actual luminance (such as 30,000 hours or 60,000 hours). The attenuation characteristics for light emission amount in this case are set such that the attenuation amount is greater than the minimum deterioration characteristics $L_{min}$ and less than the maximum deterioration characteristics $L_{max}$.

Moreover, the attenuation characteristics for light emission amount are commonly set among all colors so as not to generate color differences between the pixels P of the same color. The attenuation characteristics for light emission amount which are different for each color may be set to the extent that the color differences are not generated. Moreover, the attenuation characteristics for light emission amount are, as described above, represented by the reduction amount of the actual luminance relative to time. The actual luminance relative to time may be attenuated linearly or may be attenuated quadratically. The attenuation characteristics for light emission amount are stored in advance in a storage unit (not illustrated) of the organic EL panel 110.

Figure 3:
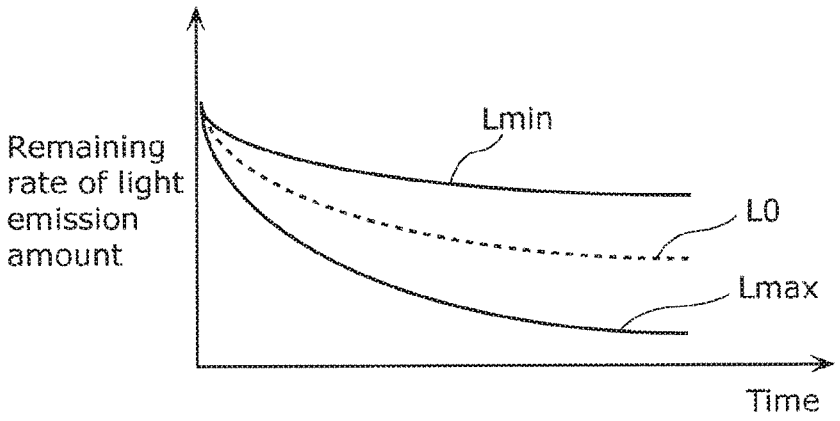
FIG. 3 illustrates an example of attenuation characteristics for light emission amount, minimum deterioration characteristics, and maximum deterioration characteristics according to an embodiment.

FIG. 3 illustrates examples of the attenuation characteristics for light emission amount L0, the minimum deterioration characteristics $L_{min}$, and the maximum deterioration characteristics $L_{max}$. In FIG. 3, the attenuation characteristics for light emission amount L0 are defined by the deterioration rate relative to elapsed time. In the present embodiment, the deterioration rate is, as described above, defined by the rate of the remaining luminance of the pixel P to the initial actual luminance of the pixel P in the initial state (remaining luminance/initial actual luminance).

As illustrated in FIG. 3, the attenuation characteristics for light emission amount L0 are set such that the deterioration amount is, at any given time, greater than the minimum deterioration characteristics $L_{min}$, and less than the maximum deterioration characteristics $L_{max}$.

Here, the minimum deterioration characteristics $L_{min}$ are, for example, represented by the physical deterioration amount (for example, deterioration rate) of the pixel P with the minimum deterioration characteristics, relative to the elapsed time. The physical deterioration amount of the pixel P with the minimum deterioration characteristics may be, for example, expressed by using an estimated value statistically calculated, or may be an experimentally obtained value. More specifically, for example, in the case where a test image signal (ordinary broadcast waves may be used) is displayed on the organic EL display 1, the deterioration amount is obtained for each pixel P included in the organic EL panel 110. Of the derived deterioration amount, the minimum deterioration amount is the physical deterioration amount of the pixel P with the minimum deterioration characteristics. In this case, the pixel P with the minimum deterioration characteristics may be different at respective times.

The maximum deterioration characteristics $L_{max}$ are, for example, represented by the physical deterioration amount (for example, deterioration rate) of the pixel P with the maximum deterioration characteristics relative to the elapsed time. The physical deterioration amount of the pixel P with the maximum deterioration characteristics may be, for example, expressed by an estimated value statistically calculated, or an experimentally obtained value. More specifically, for example, in the case where a test image signal (ordinary broadcast waves may be used) is displayed on the organic EL display 1, the deterioration amount is obtained for each pixel P included in the organic EL panel 110. Of the derived deterioration amount, the maximum deterioration amount is the physical deterioration amount of the pixel P with the maximum deterioration characteristics. In this case, the pixel P with the maximum deterioration characteristics may be different at respective times.

[2-2. Correction of Luminance Signal]

Next, an example of the operations of the correction value calculation unit 230 (the method for driving the display device) will be described with reference to FIGS. 2, 4 and 5. Note that the operations of the correction value calculation unit 230 described below are merely an example, and are not limited to such an example.

The correction value calculation unit 230 calculates a correction signal to be supplied to the target pixel P to be corrected, such that the actual luminance of the target pixel P is equal to the actual luminance of a reference pixel to which the second luminance signal is supplied.

As FIG. 2 illustrates, the multiplier 231 multiplies the second luminance signal by (1/initial efficiency $\eta 0$). Here, the actual luminance of the pixel P that has not been deteriorated (that is, the initial actual luminance L) is represented by $\eta 0\times$ I. I refers to the value of current (corresponding to a luminance signal).

The multiplier 232 multiplies the output signal ($L/\eta 0$) from the multiplier 231 by (1/remaining rate $\Delta\eta$) calculated by the deterioration amount calculation unit 233 to be described later. The remaining rate $\Delta\eta$ is, in the target pixel P, the rate of the current actual luminance to the initial actual luminance. The multiplication result $L/(\eta 0\times\Delta\eta)$ obtained by the multiplier 232 is equivalent to the value of current that needs to be supplied to the pixel P in order to obtain the actual luminance in the initial state in the organic EL panel 110.

The deterioration amount calculation unit 233 calculates the remaining rate (=1−deterioration rate) by using the multiplication result obtained by the multiplier 232. The remaining rate is an example of the deterioration amount. The remaining rate is, for example, defined by using the rate of the remaining actual luminance which is the current actual luminance of the pixel P to the initial actual luminance of the pixel P (remaining actual luminance/initial actual luminance).

The deterioration amount is determined from the amount of current actually supplied to the pixel P. However, since it is difficult to directly measure the amount of current, the deterioration amount is obtained by calculation in the present embodiment. More specifically, for example, the deterioration amount is obtained by the multiplication result $L/(\eta 0\times\Delta\eta)$ obtained by the multiplier 232.

The multiplier 234 multiplies the second luminance signal by (1/remaining rate $\Delta\eta$) calculated by the deterioration amount calculation unit 233.

The gray level correction calculation unit 235 converts the value of the luminance signal $L/\Delta\eta$, which has been adjusted so that a target initial actual luminance L is generated in a deteriorated organic EL element OEL, to the gray level to be set to the display unit 10. The relationship between the gray level and luminance is set in advance, and thus, the gray level corresponding to the luminance signal $L/\Delta\eta$ is selected by the gray level correction calculation unit 235.

Figure 4:
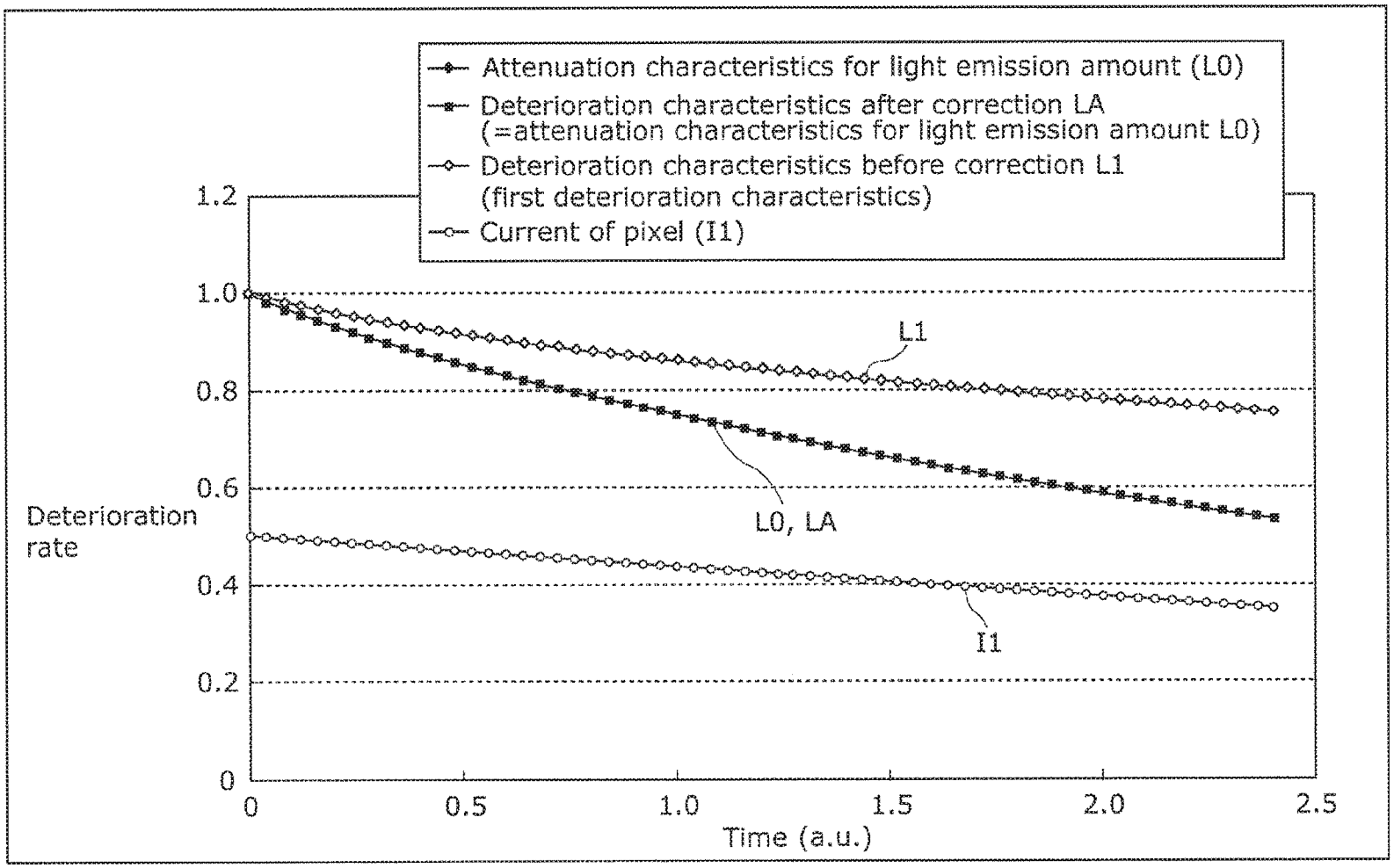
FIG. 4 is a graph showing the deterioration characteristics before and after correction and the amount of current, with respect to a first pixel having first deterioration characteristics in which the deterioration amount is less than the attenuation characteristics for light emission amount.

FIG. 4 is a graph showing the deterioration characteristics of a pixel P (first pixel) before and after the correction and the current amount I1 flowing through the pixel P. The pixel P has first deterioration characteristics L1 in which the deterioration amount (attenuation amount) relative to the elapsed time is less than the attenuation characteristics for light emission amount.

As can be understood from FIG. 4, the deterioration amount of the first deterioration characteristics L1 relative to the elapsed time is less than the attenuation characteristics for light emission amount L0. In other words, the deterioration amount of the first deterioration characteristics L1 is less than the reduction rate defined in the luminance reduction calculation unit 220. Therefore, as a result, a process for reducing the value of the luminance signal input to the control unit 20 is performed on the pixel P with the first deterioration characteristics L1. That is, the value of the current amount I1 flowing through the pixel P with the first deterioration characteristics L1 decreases over time.

Figure 5:
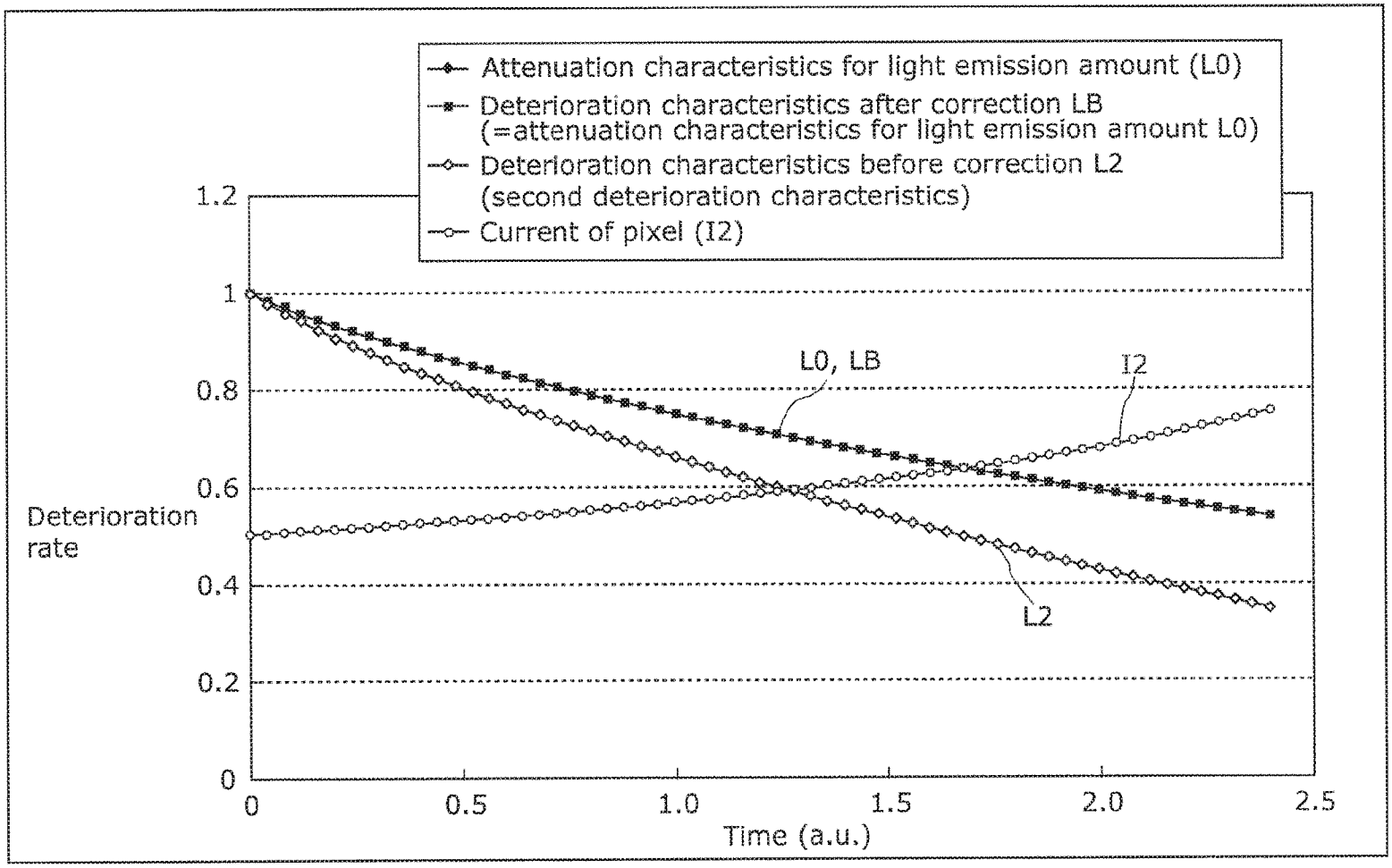
FIG. 5 is a graph showing the deterioration characteristics before and after correction and the amount of current with respect to a second pixel having second deterioration characteristics in which the deterioration amount is greater than the attenuation characteristics for light emission amount.

FIG. 5 is a graph showing the deterioration characteristics of a pixel P (second pixel) before and after the correction and the current amount 12 flowing through the pixel P. The pixel P has second deterioration characteristics L2 in which the deterioration amount (attenuation amount) relative to the elapsed time is less than the attenuation characteristics for light emission amount.

As can be understood from FIG. 5, the deterioration amount of the second deterioration characteristics L2 relative to the elapsed time is greater than the attenuation characteristics for light emission amount L0. In other words, the deterioration amount of the second deterioration characteristics L2 is greater than the reduction rate defined in the luminance reduction calculation unit 220. Therefore, a process for increasing the value of the luminance signal input to the control unit 20 is performed on the pixel P with the second deterioration characteristics L2. That is, the value of the current amount 12 flowing through the pixel P with the second deterioration characteristics L2 increases over time.

3. Advantageous Effects, Etc

In the organic EL display 1 according to the present embodiment, as described above, the value of the luminance signal to be supplied to a target pixel to be corrected is adjusted such that the actual luminance of the target pixel is equal to the actual luminance of a reference pixel having predetermined attenuation characteristics for light emission amount. Accordingly, it is possible to maintain the luminance difference between the high luminance region and the low luminance region of an image signal. Moreover, the organic EL display 1 according to the present embodiment is capable of maintaining an intended luminance difference in an image signal, and thus, it is possible to appropriately avoid the burn-in phenomenon while effectively preventing the reduction of the image quality.

Moreover, the organic EL display 1 according to the present embodiment corrects a luminance signal according to the attenuation characteristics for light emission amount, instead of correcting the luminance signal so as to obtain the initial actual luminance or to obtain the actual luminance same as the pixel having the minimum deterioration characteristics. As a result, it is possible to effectively prevent the progression speed of deterioration from increasing, that is, it is possible to prevent the reduction speed of the life from increasing.

More specifically, in the conventional organic EL display, when a luminance signal is corrected so as to obtain the initial actual luminance, the luminance signal is corrected so as to increase the luminance value for both a deteriorated pixel (with a large deterioration amount) and a pixel with a small deterioration amount. In the organic EL display 1 according to the present embodiment, a luminance signal is corrected so as to increase the luminance value for a pixel with a large deterioration amount, as in the conventional technique. However, for a pixel with a small deterioration amount, a luminance signal is corrected to reduce the luminance value in an opposite manner to the conventional technique. Therefore, an increase in deterioration amount for a pixel with a small deterioration amount can be further reduced. Moreover, since a small amount of correction is made for a pixel with a large deterioration amount, an increase in deterioration amount can also be further reduced.

Moreover, when a luminance signal is corrected to obtain the actual luminance same as that of a pixel having the minimum deterioration characteristics as in the conventional technique, an increase in deterioration amount can be reduced. However, the deterioration of the actual luminance generated over time increases, which might lead to a significant reduction in image quality over time. In contrast, since the organic EL display 1 according to the present embodiment is capable of controlling, by the design, the deterioration of the actual luminance generated over time, significant reduction in image quality can be prevented.

In other words, in the organic EL display 1 according to the present embodiment, it is possible to obtain two advantageous effects simultaneously: reducing an increase in physical deterioration amount of the pixels and controlling the deterioration of the actual luminance generated over time. Control of the deterioration of the actual luminance generated over time allows the image quality to be controlled at the design side.

Moreover, the deterioration of the actual luminance of a product can be controlled by setting the attenuation characteristics for light emission amount in accordance with the product specification of the organic EL display 1.

4. Verification

It is possible to verify whether or not the organic EL display according to the present embodiment is being used, for example, as follows.

In the display unit of an organic EL display, a non-light-emitting region and a light-emitting region are set. In the non-light-emitting region, a data signal from the data line drive circuit 120 illustrated in FIG. 1B is physically blocked. For each of the non-light-emitting region and the light-emitting region, a high load region in which a high load is applied to the organic EL elements (for example, a region which constantly has a high luminance value) and a low load region in which a low load is applied to the organic EL elements (for example, a region which constantly has a low luminance value) are set. In other words, four regions of a non-light-emitting high load region, a non-light-emitting low load region, a light-emitting high load region, and a light-emitting low load region are set.

An image is displayed in the high load region and the low load region for a predetermined time period.

(Condition a) Here, in the organic EL display according to the present embodiment, the actual luminance is adjusted according to the attenuation characteristics for light emission amount. Hence, the attenuation characteristics for the actual luminance are considered to match in the light-emitting high load region and the light-emitting low load region.

(Condition b) Moreover, a data signal from the data line drive circuit 120 is physically connected to the non-light-emitting regions for every predetermined period to measure the actual luminance. Here, since no current flows through the pixels in the non-light-emitting regions except for the test period, it can be considered that the initial status with no deterioration is maintained.

In the case of the organic EL display according to the present embodiment, as described with reference to FIG. 4, the luminance signals are corrected in the non-light-emitting low load region, so as to gradually reduce the luminance values as in the light-emitting low load region. In other words, even though the pixels in the non-light-emitting low load region are not actually deteriorated, the luminance signals are corrected to reduce the luminance values. Therefore, the actual luminance values of the pixels in the non-light-emitting low load region are considered to gradually decrease.

Moreover, in the case of the organic EL display according to the present embodiment, as described with reference to FIG. 5, the luminance signals are corrected in the non-light-emitting high load region, so as to gradually increase the luminance values as in the light-emitting high load region. In other words, even though the pixels in the non-light-emitting high load region are not actually deteriorated, the luminance signals are corrected to increase the luminance values. Therefore, the actual luminance values of the pixels in the non-light-emitting high load region are considered to gradually increase.

From the above, it is considered that the organic EL display according to the present embodiment are being used, when condition a, in which the attenuation characteristics for the actual luminance match in the light-emitting high load region and the light-emitting low load region, and condition b, in which the actual luminance in the non-light-emitting low load region gradually decreases and the actual luminance in the non-light-emitting high load region gradually increases, are satisfied.

In contrast, for example, in the display device described in PTL 1, it is considered that condition b is not satisfied because there are periods in which the actual luminance increases and periods in which the actual luminance reduces.

Variations, Etc. of Embodiment

In the above embodiment, each of the structural components (in particular, the control unit 20) may be configured in the form of an exclusive hardware product, or may be realized by executing a software program suitable for the structural component. Each of the structural components may be realized by means of a program executing unit, such as a CPU and a processor, reading and executing the software program recorded on a recording medium such as a hard disk or a semiconductor memory. Here, the software program for realizing the display device according to the above embodiment is the program described below.

That is, the program causes a computer to execute: adjusting a value of a luminance signal to be supplied to a target pixel to be corrected, such that an actual luminance of the target pixel is equal to a reference luminance, the reference luminance being an actual luminance of a reference pixel obtained when the luminance signal to be supplied to the target pixel is supplied to the reference pixel, the reference pixel having a predetermined attenuation characteristic for light emission amount.

Although the display device and the method for driving the display device has been described based on the above embodiment, the present invention is not limited to such an embodiment. Forms obtained by various modifications to the embodiment that can be conceived by a person of skill in the art as well as forms realized by combining structural components in the embodiment and Variation, which are within the scope of the essence of the present invention may be included in one or more aspects.

INDUSTRIAL APPLICABILITY

The display device and the method for driving the display device according to the present invention are useful in technical fields including displays of a flat-screen TV and a personal computer.

REFERENCE SIGNS LIST

1 Organic EL display
10 Display unit
20 Control unit
110 Organic EL panel
120 Data line drive circuit
130 Scanning line drive circuit
210 Display state detection unit
220 Luminance reduction calculation unit
221 Reduction rate calculation unit
222, 231, 232, 234 Multiplier
230 Correction value calculation unit
233 Deterioration amount calculation unit
235 Gray level correction calculation unit
P Pixel
GL Scanning line
SL Data line
OEL Organic EL element
T1 Selection transistor
T2 Drive transistor
C1 Capacitor element
N1 Node
L0 Attenuation characteristics for light emission amount
$L_{min}$ Minimum deterioration characteristics
$L_{max}$ Maximum deterioration characteristics

The invention claimed is:

1. A display device comprising:

a display which includes a plurality of pixels each including a light emitting element; and a controller configured to adjust a value of a luminance signal to be supplied to a target pixel, such that an actual luminance of the target pixel is equal to a reference luminance, the reference luminance being an actual luminance of a reference pixel obtained when the luminance signal to be supplied to the target pixel is supplied to the reference pixel, the reference pixel having a predetermined attenuation characteristic for light emission amount, wherein, in the adjustment of the value of the luminance signal, the controller is configured to:

reduce the value of the luminance signal for a first target pixel having a first deterioration characteristic in which an attenuation amount of the actual luminance of the first target pixel over time is less than an attenuation amount of the luminance of the first target pixel over time specified by the predetermined attenuation characteristic for the light emission amount; and increase the value of the luminance signal for a second target pixel having a second deterioration characteristic in which an attenuation amount of the actual luminance of the second target pixel over time is greater than an attenuation amount of the luminance of the second target pixel over time specified by the predetermined attenuation characteristic for the light emission amount, wherein the luminance signal for the first target pixel is reduced at a first rate and the luminance signal for the second target pixel is increased at a second rate different from the first rate to equalize attenuation characteristics of the first target pixel and the second target pixel for maintaining a luminance difference between the first target pixel and the second pixel with respect to time, wherein the value of the luminance signal is adjusted by adjusting an amount of current transmitted to the light emitting element corresponding to the target pixel, and wherein the amount of current is adjusted according to the physical deterioration amount of the lighting emitting element in the target pixel.

2. The display device according to claim 1, wherein the predetermined attenuation characteristic for the light emission amount is defined by an attenuation amount of the actual luminance of the reference pixel relative to elapsed time, the predetermined attenuation characteristic for the light emission amount is set such that the attenuation amount is (i) greater than a minimum deterioration characteristic in which the attenuation amount relative to elapsed time is a minimum, and (ii) less than a maximum deterioration characteristic in which the attenuation amount relative to elapsed time is a maximum, and the minimum deterioration characteristic and the maximum deterioration characteristic are statistically estimated.

3. The display device according to claim 1, wherein the predetermined attenuation characteristic for light emission amount is predesigned according to a specification of the display device.

4. The display device according to claim 1, wherein the light emitting element is an organic electroluminescent element.

5. The display device according to claim 1, wherein the controller detects the light emission state of the display, and equally reduces the value of the luminance signal for all of the pixels at a same reduction rate based on an accumulation of periods during which images are displayed on the display derived from the detected light emission state of the display, and adjusts the reduced value of the luminance signal for the target pixel at a first time, the adjustment being based on a comparison of the actual value of the luminance of the reference pixel at the first time and an attenuation amount of the luminance of the reference pixel at the first time specified by the predetermined attenuation characteristic of the reference pixel.

6. The display device according to claim 1, wherein the reference pixel is a virtual pixel.

7. The display device according to claim 1, wherein the attenuation characteristics for light emission amount are commonly set among all colors.

8. The display device according to claim 1, wherein deterioration characteristics for light emission amount of the first target pixel is reduced with respect to time at a greater rate with the adjustment of the value of the luminance signal than deterioration characteristics for light emission amount of the first target pixel without the adjustment of the value of the luminance signal, and wherein deterioration characteristics for light emission amount of the second target pixel is reduced with respect to time at a lower rate with the adjustment of the value of the luminance signal than deterioration characteristics for light emission amount of the second target pixel without the adjustment of the value of the luminance signal.

9. The display device according to claim 1, wherein different deterioration rates are set for the first target pixel and the second target pixel.

10. The display device according to claim 9, wherein the first target pixel and the second target pixel are located at different regions displaying different amount of luminance data with respect to time.

11. A method for driving a display device which includes a display which includes a plurality of pixels each including a light emitting element, the method comprising:

adjusting, by a controller of the display device, a value of a luminance signal to be supplied to a target pixel, such that an actual luminance of the target pixel is equal to a reference luminance, the reference luminance being an actual luminance of a reference pixel obtained when the luminance signal to be supplied to the target pixel is supplied to the reference pixel, the reference pixel having a predetermined attenuation characteristic for light emission amount, the adjusting comprising:

reducing the value of the luminance signal for a first target pixel having a first deterioration characteristic in which an attenuation amount of the actual luminance of the first target pixel over time is less than an attenuation amount of the luminance of the first target pixel over time specified by the predetermined attenuation characteristic for the light emission amount; and increasing the value of the luminance signal for a second target pixel having a second deterioration characteristic in which an attenuation amount of the actual luminance of the second target pixel over time is greater than an attenuation amount of the luminance of the second target pixel over time specified by the predetermined attenuation characteristic for the light emission amount, wherein the luminance signal for the first target pixel is reduced at a first rate and the luminance signal for the second target pixel is increased at a second rate different from the first rate to equalize attenuation characteristics of the first target pixel and the second target pixel for maintaining a luminance difference between the first target pixel and the second pixel with respect to time, wherein the value of the luminance signal is adjusted by adjusting an amount of current transmitted to the light emitting element corresponding to the target pixel, and wherein the amount of current is adjusted according to the physical deterioration amount of the lighting emitting element in the target pixel.

12. The method according to claim 11, further comprising:

detecting the light emission state of the display, equally reducing the value of the luminance signal for all of the pixels at a same reduction rate based on an accumulation of periods during which images are displayed on the display derived from the detected light emission state of the display, and adjusting the reduced value of the luminance signal for the target pixel at a first time, the adjustment being based on a comparison of the actual value of the luminance of the reference pixel at the first time and an attenuation amount of the luminance of the reference pixel at the first time specified by the predetermined attenuation characteristic of the reference pixel.

13. A display device comprising:

a display which includes a plurality of pixels each including a light emitting element; and a controller that adjusts a value of a luminance signal to be supplied to a target pixel, such that an actual luminance of the target pixel is equal to a reference luminance, the reference luminance being an actual luminance of a reference pixel obtained when the luminance signal to be supplied to the target pixel is supplied to the reference pixel, the reference pixel having a predetermined attenuation characteristic for light emission amount, wherein the controller detects the light emission state of the display, and equally reduces the value of the luminance signal for all of the pixels at a same reduction rate based on an accumulation of periods during which images are displayed on the display derived from the detected light emission state of the display, and adjusts the reduced value of the luminance signal for the target pixel at a first time, the adjustment being based on a comparison of the actual value of the luminance of the reference pixel at the first time and an attenuation amount of the luminance of the reference pixel at the first time specified by the predetermined attenuation characteristic of the reference pixel, wherein the adjustment in the value of the luminance signal is to allow equalization of attenuation characteristics for maintaining a luminance difference between a pixel located in a high luminance region and a pixel located in a low luminance region, wherein the value of the luminance signal is adjusted by adjusting an amount of current transmitted to the light emitting element corresponding to the target pixel, and wherein the amount of current is adjusted according to the physical deterioration amount of the lighting emitting element in the target pixel.

* * * * *